US006209445B1

(12) United States Patent
Roberts, Jr. et al.

(10) Patent No.: US 6,209,445 B1
(45) Date of Patent: Apr. 3, 2001

(54) LINER RETAINER ASSEMBLY

(75) Inventors: Emmett T. Roberts, Jr., Houston; Thomas Christopher Leman, Galveston, both of TX (US)

(73) Assignee: Southwest Oilfield Products, Inc., Houston, TX (US)

( * ) Notice: Subject to any disclaimer, the term of this patent is extended or adjusted under 35 U.S.C. 154(b) by 0 days.

(21) Appl. No.: 09/146,786

(22) Filed: Sep. 3, 1998

(51) Int. Cl.[7] ..... F01B 29/00
(52) U.S. Cl. ..... 92/128; 92/171.1
(58) Field of Search ..... 92/128, 171.1

(56) References Cited

U.S. PATENT DOCUMENTS

| | | | | |
|---|---|---|---|---|
| 2,650,868 | | 9/1953 | Waldron | 309/3 |
| 2,717,186 | | 9/1955 | Campbell | 309/3 |
| 2,732,809 | | 1/1956 | Mattingly et al. | 103/216 |
| 2,981,575 | | 4/1961 | Leman | 309/3 |
| 3,008,429 | | 11/1961 | Stahl et al. | 103/216 |
| 3,037,460 | | 6/1962 | Guest et al. | 103/216 |
| 3,137,216 | | 6/1964 | Aytes | 92/171 |
| 3,277,837 | | 10/1966 | Pangburn | 103/216 |
| 3,327,643 | | 6/1967 | Pangburn | 103/216 |
| 3,435,777 | | 4/1969 | Schaaf | 103/217 |
| 3,438,334 | | 4/1969 | Schaaf | 103/216 |
| 3,610,110 | * | 10/1971 | Schaaf | 92/171.1 |
| 3,635,616 | | 1/1972 | Venkatesan | 425/77 |
| 3,773,152 | | 11/1973 | Sitton | 188/170 |
| 3,786,729 | | 1/1974 | Rizzone | 92/171 |
| 4,516,477 | | 5/1985 | Lewis et al. | 92/128 |
| 5,307,915 | | 5/1994 | Grosspietsch et al. | 192/98 |
| 5,572,920 | * | 11/1996 | Kennedy et al. | 92/128 |
| 5,616,009 | | 4/1997 | Birdwell | 417/342 |

OTHER PUBLICATIONS

*Kwik Clamp, Liner Retention Systems*, P–QUIP Oilfield Products, 6 pages, undated.
*Kwik Cover, National 14–P–200 (6000PSI–W.P.)*, P–QUIP Ltds., 4 pages, undated.
International Search Report Dated Feb. 9, 2000; (4 p.).

* cited by examiner

*Primary Examiner*—Edward K. Look
*Assistant Examiner*—Thomas E. Lazo
(74) *Attorney, Agent, or Firm*—Conley, Rose & Tayon, P.C.

(57) ABSTRACT

The liner retainer assembly includes a cylinder that is mounted on a module of the fluid end of a pump. The cylinder has an aperture for receiving a liner and a retaining piston. A retaining nut is secured on the end of the retaining piston and engages one end of the liner. The retaining piston forms a fluid cavity and a spring cavity within the cylinder. The spring cavity houses a plurality of springs which bias the piston, retaining member, and liner towards the module, thus providing a resilient securing force. The fluid cavity communicates with a supply of hydraulic fluid for biasing the piston away from the module to relieve the springs. By pressurizing the fluid cavity, the springs are compressed to disengage the retaining member from the liner and allow the unthreading of the retaining member and then the removal of the liner.

13 Claims, 5 Drawing Sheets

60
15
46
18
42
50
35
32
49
38
26
58
28
22
23
10
14
16
61
24
30
33
20
44
39
56
39
59
12
48
34
35
58
26

15
64
18
42
32
58
56
20
30
10
14
16

LINER RETAINER ASSEMBLY

BACKGROUND OF THE INVENTION

1. Field of the Invention

The invention relates to an assembly for quickly securing and releasing a component to a pump housing and more particularly to a retainer assembly for releasably mounting a piston liner within a hydraulic cylinder on the module of a pump.

2. Description of the Prior Art

Heavy duty large horsepower pumps are used to pump fluids or slurries with entrained solids. In the oil industry, for example, slush or mud pumps are used to pump viscous fluids, such as drilling muds, cement, or other well fluids. Although mud pumps may be either centrifugal or reciprocating type pumps, typically mud pumps are reciprocating pumps using one or more pistons and hydraulic cylinders with liners to generate the high pressures required to pump these viscous fluids in and out of the well.

Mud pumps include a fluid end and a power end. In the fluid end of one type of a triplex mud pump, for example, there are three sets of suction modules and discharge modules in fluid communication. A suction manifold is connected to the fluid inlets of the suction modules for receiving fluids and passing those fluids to each of the suction modules. A discharge manifold is connected to the fluid outlets of the discharge modules for discharging the pumped fluids. Each module encloses a set of flow passages with check valves for controlling the direction of flow of the fluids. A check valve is disposed at the suction module fluid inlet to only allow fluids to enter the suction module inlet end of the module and another check valve is disposed at the discharge module fluid outlet to only allow fluids to exit the the discharge module for flow into the discharge manifold.

Each discharge module includes a liner retainer flange attached to the discharge module. The liner retainer flange attaches to a replaceable liner within which a pump piston reciprocates. The piston is a generally cylindrical steel member having a polymer, such as polyurethane, bonded to its outer diameter for sealingly engaging the inner cylindrical wall of the liner to ensure a fluid tight seal required for drawing the low pressure fluids through the suction manifold and module flow passages. The seal integrity must be maintained to withstand the high discharge pressure on the discharge stroke. The power end contains the gears that reciprocate the pump piston within the liner for pumping the fluid through the module passages in the fluid end and thence out the discharge valve.

In operation, on the suction stroke, the pump piston draws fluids through the suction manifold and suction valve as the piston strokes within the liner. On the discharge stroke, the check valve in the discharge module opens simultaneously as the suction valve closes preventing suction back flow into the suction module. Fluid in the liner is compressed and pressure is built up until the pressure overcomes well bore pressure so as to pump the mud into the well. The piston then reverses for another suction stroke whereby the check valve in the suction module opens and the discharge valve closes simultaneously, the piston now making a suction stroke.

As the piston reciprocates within the liner, friction wears the liner. Further, the fluid passing through the fluid end includes particulates and other solids which wear away and destroy the liner and piston. When the liner and piston degrade, the fluid seal is lost and the pump becomes much less efficient. Also, the reciprocation of the piston in the liner causes pulsations that over time cause the liner to become loose within the containment of the liner retainer flange thus resulting in a degradation of the seal at the face of the liner and the seal at the face of the liner wear plate. Therefore, it is important to be able to replace the liner as a part of routine maintenance (or when emergencies occur from seal failure while drilling) to ensure that the pump operates efficiently and can control well pressure. It is also important to have a means for fastening the liner to the liner retainer flange so as to ensure that the liner remains firmly secured despite extended reciprocation of the piston assembly within the liner.

Typically each liner retainer flange, and the cradle of the pump power end are all secured to the fluid end module by studs and threaded connections. Because of the environment in which the mud pump operates and the corrosive nature of the fluids being pumped, the studs and threaded connections, such as nuts, become corroded and are difficult to unthread for the replacement of the liner. Often, the threaded connections have been over tightened, making it even more difficult to unthread. Where the liner is retained by an end cap, a steel bar is inserted into a guide hole in the side of the end cap and then the cap is unscrewed using a significant amount of torque. This end cap is very heavy as it must have sufficient strength to keep the liner from moving, even with pressures up to 7500 psi. Where a nut or end cap resists unscrewing, a sledge hammer is used to hammer on a socket wrench or a special hammer wrench is used to loosen the nut or cap. Such activity is obviously dangerous. In some regions of the world local laws prohibit the use of sledge hammers for personnel safety reasons or to avoid the risk of an explosion due to sparks.

Prior art liner retention systems include spring mechanisms around each stud with an end flange for securing the liner against a fluid end module. Hydraulic pressure is applied to the spring mechanism of each stud by a small hydraulic pump to remove the clamping force of the spring mechanism. The release of the clamping force allows the removal of the clamping flange of the liner retention system. Individually actuated spring loaded studs cause an uneven pressure to be applied to the clamping flange. Further, the clamping force is limited because of the limited space available to hold numerous springs.

The present invention overcomes the deficiencies of the prior art.

SUMMARY OF THE INVENTION

The liner retainer assembly of the present invention includes a liner retainer flange that is mounted on the discharge module of the fluid end of a pump. A pressure actuated hydraulic clamping piston with related actuated, conical dished washers and necessary static and sliding seals is disposed within the retainer flange . The hydraulic pressure actuated clamping piston is configured to receive and hold the liner. The hydraulic clamping piston and an end cap maintain the liner in contact with the module during actuation. The hydraulic clamping cylinder includes a counterbore which is divided by the hydraulic piston into a fluid cavity and a spring cavity. The spring cavity houses a plurality of springs which bias the hydraulic piston, end cap, and liner towards the module, thus providing a strong clamping securing force when the hydraulic pressure is released. The fluid cavity communicates with a supply of hydraulic fluid for biasing the hydraulic piston away from the module to activate the springs. By pressurizing the fluid cavity, the springs are compressed so as to disengage the liner retaining end cap from the liner and allow the unthreading of the liner end cap to then remove the liner.

The liner retainer assembly permits preloading or prestressing of the liner against the module of the fluid end of the pump so that the liner will not loosen upon the reciprocation of the pump piston within the liner. Further, the liner may be easily secured and unsecured from the module without the necessity of a sledge hammer or other methods for applying excessive amounts of torque to a securing fitting. The assembly of the present invention permits the easy and quick replacement of the liner as necessary.

Other objects and advantages of the invention will appear from the following description.

BRIEF DESCRIPTION OF THE DRAWINGS

For a detailed description of a preferred embodiment of the invention, reference will now be made to the accompanying drawings wherein.

DETAILED DESCRIPTION OF THE PREFERRED EMBODIMENTS

Figure 1:
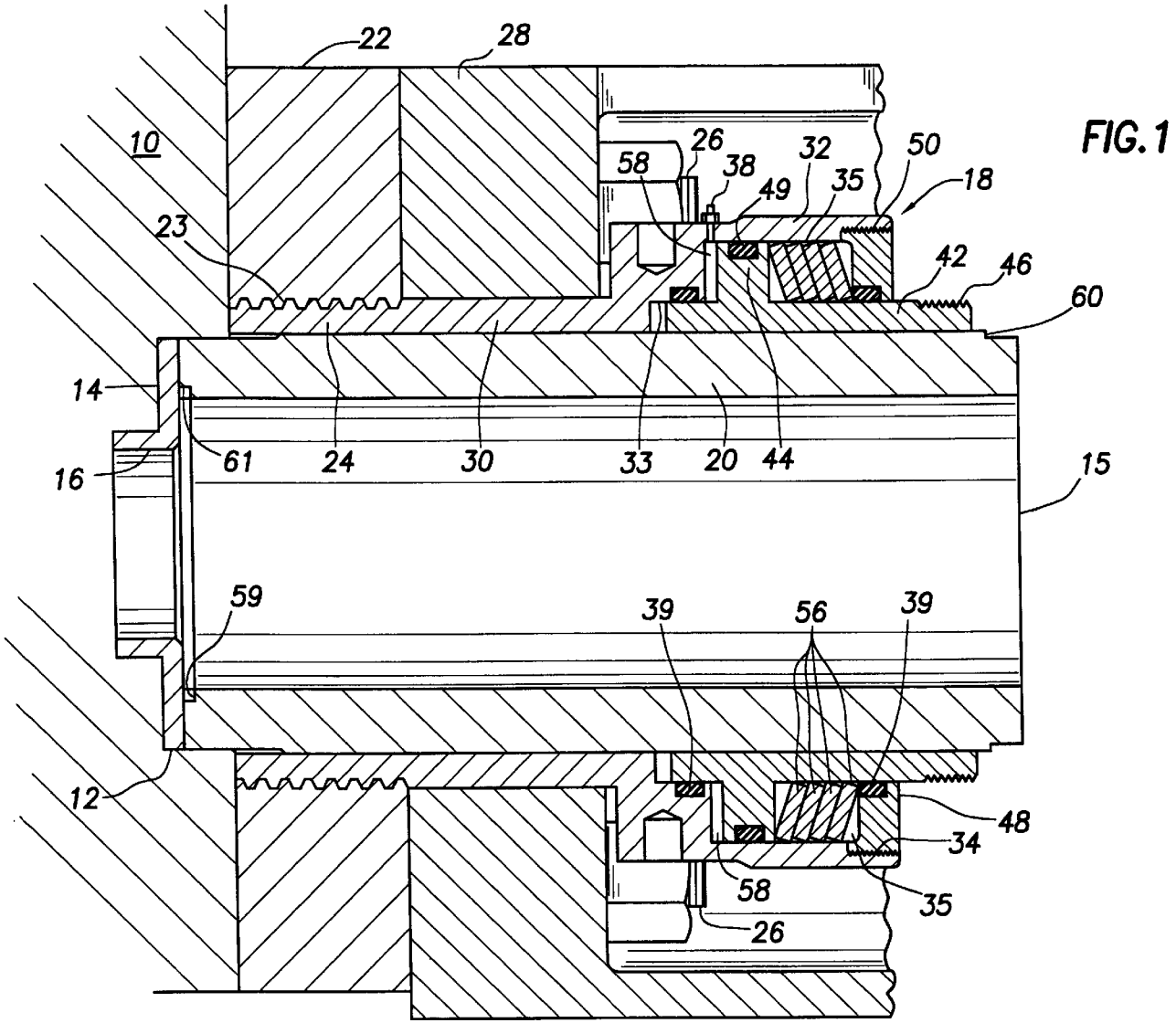
FIG. 1 is a cross-sectional view of a typical liner inserted into a liner retaining flange housing assembly constructed in accordance with the present invention.
Figure 2:
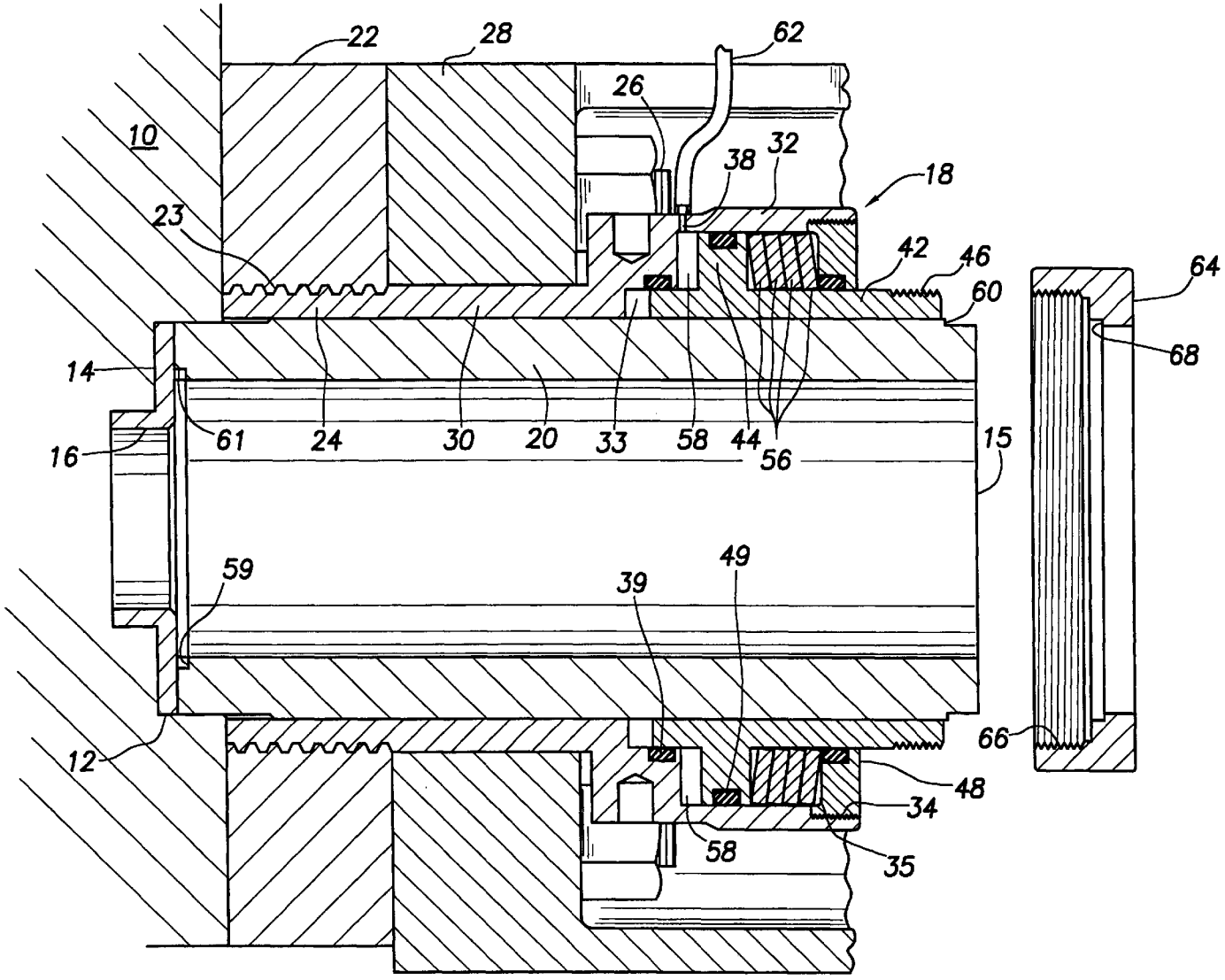
FIG. 2 is a cross-sectional view and partial exploded view of the liner retaining flange assembly of FIG. 1 illustrating the application of hydraulic pressure for the attachment of a retaining cap.

Referring first to FIGS. 1 and 2, there is shown a fluid end module 10 and a cradle 28 of the pump power end. The pump is of the type used to pump fluids, such as drilling muds, cement or the like. Pumps of this type are well known. A wear plate 14 defines a bore 16 which leads into liner 20. The module 10 is used for the transfer of fluid from the suction manifold and suction module (not shown) to the discharge manifold (not shown) and discharge module.

An exemplary liner retaining flange assembly 18 of the present invention is used to secure liner 20 within a hydraulic cylinder 30 mounted on module 10 and liner retainer flange 22. Those of skill in the art will understand that a pump piston (not shown) attached to the power end of the pump is reciprocated within the liner 20 to effect the desired pumping action to flow fluid through the fluid end module 10 of the pump. Hydraulic cylinder 30 provides an open end into which the liner 20 is inserted. Module 10 also provides a counterbore 12 for the adjacent wear plate 14 against which it is desired to retain the liner 20 during operation of the pump piston. It can be appreciated that the purpose of wear plate 14 is to avoid the end of liner 20 wearing module 10 due to the reciprocation of the piston within liner 20. However, wear plate 14 may cause wear to the module 10 if the liner 20 is not securely affixed. Wear plate 14 may be replaced should that wear become excessive. It is noted that the end of the liner 20 adjacent the wear plate 14 includes an internal annular groove 59 with seal member 61 for sealingly engaging the wear plate 14 and the other open end 15 of liner 20 includes an external annular load-bearing shoulder 60 which retains end cap 64 (FIG. 2).

The hydraulic cylinder 30 includes a threaded, reduced diameter portion 24 and an enlarged diameter portion 32. Reduced diameter portion 24 is secured in a threaded or splined relation at 23 to liner retainer flange 22 that is located in an abutting relation to the module 10. Bolted studs 26 secure the cradle 28 of the pump power end, the liner retaining flange 22 and hydraulic cylinder 30 to module 10.

The enlarged portion 32 of hydraulic cylinder 30 includes an inner clearance cavity 33 which has a reduced diameter neck, forming a hydraulic cavity 58 to activate hydraulic piston 42 which in turn compresses springs 56 which are restrained from escaping from the spring cavity 35 by retainer ring 48. Hydraulic sealing is accomplished by sealing rings 39 and 49. End cap 64 is held in place with external threads 46. A hydraulic fluid port and fitting 38 is disposed through the wall of enlarged diameter portion 32.

When these components are assembled, the annular flange 44 of piston 42 forms hydraulic cavity 58 and outer spring cavity 35. The hydraulic fluid port and fitting 38 communicates with hydraulic cavity 58 for applying hydraulic pressure to flange 44. The spring cavity 35 houses a plurality of axially compressible Belleville springs or washers 56. Retainer ring 48 has external threads 50 which threadingly mate in a complimentary fashion with the internal threads 34 of enlarged diameter portion 32. The washers 56 bear against the retainer ring 48 and annular flange 44. Enough springs are used so as to insure sufficient force is generated to prevent movement of liner 20 when pump pressure is at maximum. The retainer ring 48 secures the washers 56 and hydraulic piston 42 within the enlarged diameter portion 32 of hydraulic cylinder 30. O-ring 49 provides a fluid-tight seal between the piston 42 and enlarged diameter portion 32.

Upon assembly as shown in FIG. 1, hydraulic piston 42 has previously been inserted into enlarged diameter portion 32 of cylinder 30 to form cavities 58 and 35. Belleville washers 56 are inserted into outer spring cavity 35 and retainer ring 48 is threaded into place. The liner 20 is inserted into the outer hydraulic cylinder 30 of liner retaining assembly 18 so that the end of the liner 20 with seal 61 abuts wear plate 14.

Referring particularly to FIG. 2, the retaining assembly 18 is shown ready to secure the liner 20 in place. A hydraulic hose 62 is secured to the external port and fitting 38 for supplying hydraulic fluid to inner hydraulic cavity 58. As fluid pressure is supplied to cavity 58, fluid pressure is exerted against flange 44 urging piston 42 outward toward retainer ring 48. As annular flange 44 of piston 42 is so moved, springs 56 are axially compressed. As springs 56 are compressed, the threaded end 46 of piston 42 extends further away from wear plate 14 and module 10.

In the outward and extended position of piston 42, end cap 64 is threaded onto the threaded end 46 of the piston 42 so the threads 46 mate with the threads 66 of end cap 64. End cap 64 need only be hand tightened. It is noted that liner load bearing shoulder 60 mates with the shoulder 68 on end cap 64.

Figure 3:
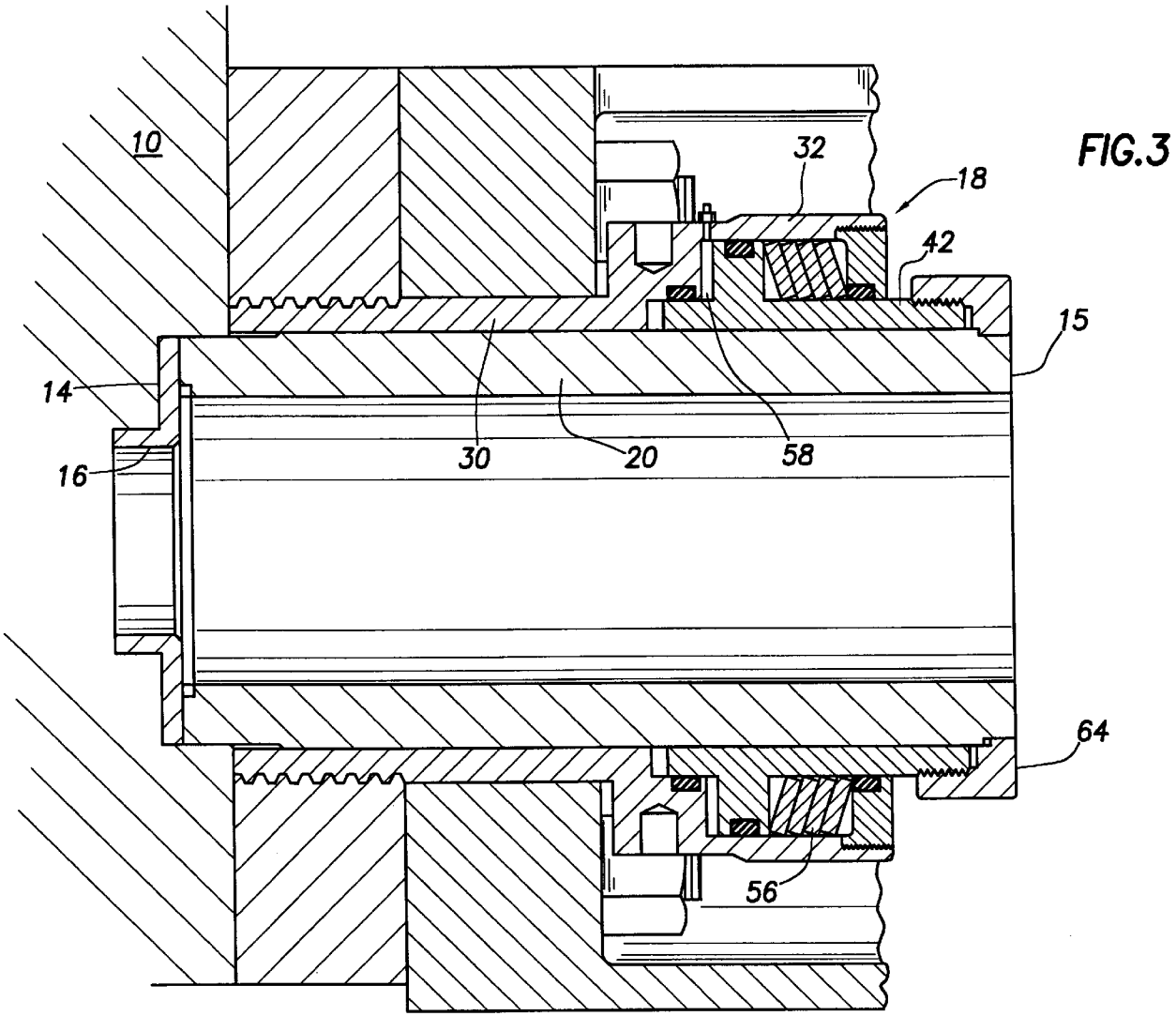
FIG. 3 is a cross-sectional view of the liner retaining flange assembly of FIGS. 1 and 2 following the attachment of the retaining cap prior to energizing the Belleville washers.

Referring now to FIG. 3, the retaining assembly 18 is shown completely assembled with the liner 20 securely affixed within the hydraulic cylinder 30. Once end cap 64 has been affixed, the fluid within the hydraulic cavity 58 is evacuated through port and fitting 38 permitting the springs 56 to bias flange 44 toward wear plate 14 and module 10 and bias end cap 64 against the other end 15 of liner 20. As the hydraulic pressure in the hydraulic cavity 58 is released, stored energy from the compression of springs 56 is released to load the liner 20 longitudinally. As a result, the energy stored by compressing springs 56 is transmitted to the liner 20 in order to load it longitudinally against wear plate 14 and module 10.

In order to remove the liner 20, the procedure is substantially reversed. Fluid is introduced into the hydraulic cavity 58 through port and fitting 38 in the same manner as previously described to compress springs 56 and external piston 42. Once spring forces are removed, end cap 64 may then be unthreaded. Fluid is bled off, springs 56 are decompressed and the unit is stabilized.

It is noted that the arrangement of the present invention permits a liner to be replaced rapidly and easily and without the use of extra tools or having to apply excessive torque. Further, a prestress force is applied to the liner 20 so that it is longitudinally compressed against wear plate 14 and module 10. This load or prestress securely holds the liner 20 against the wear plate 14 despite repeated reciprocation of the pump piston within liner 20.

Figure 4:
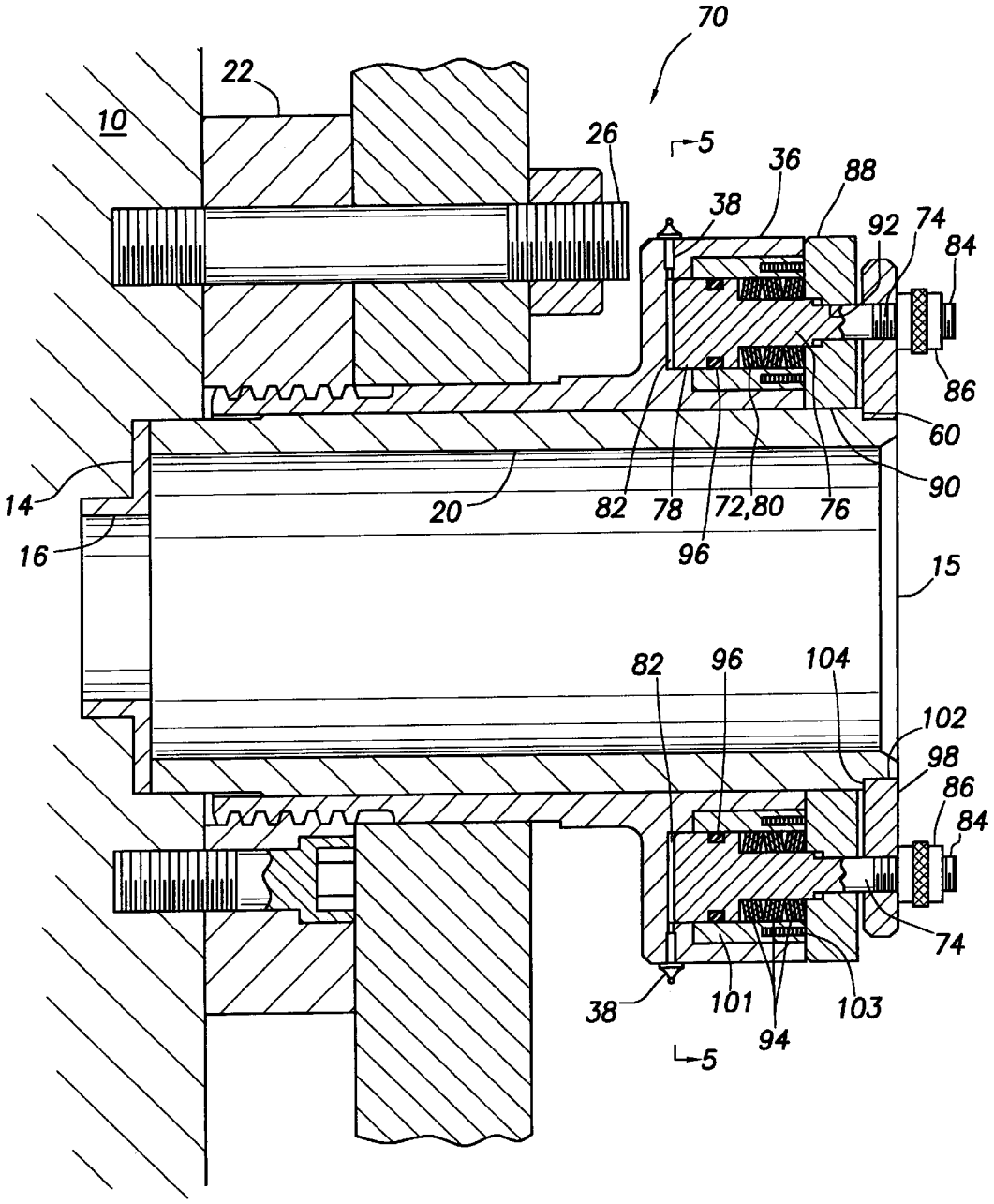
FIG. 4 is a cross-sectional view of an alternative exemplary embodiment of a liner retaining assembly of the present invention.
Figure 5:
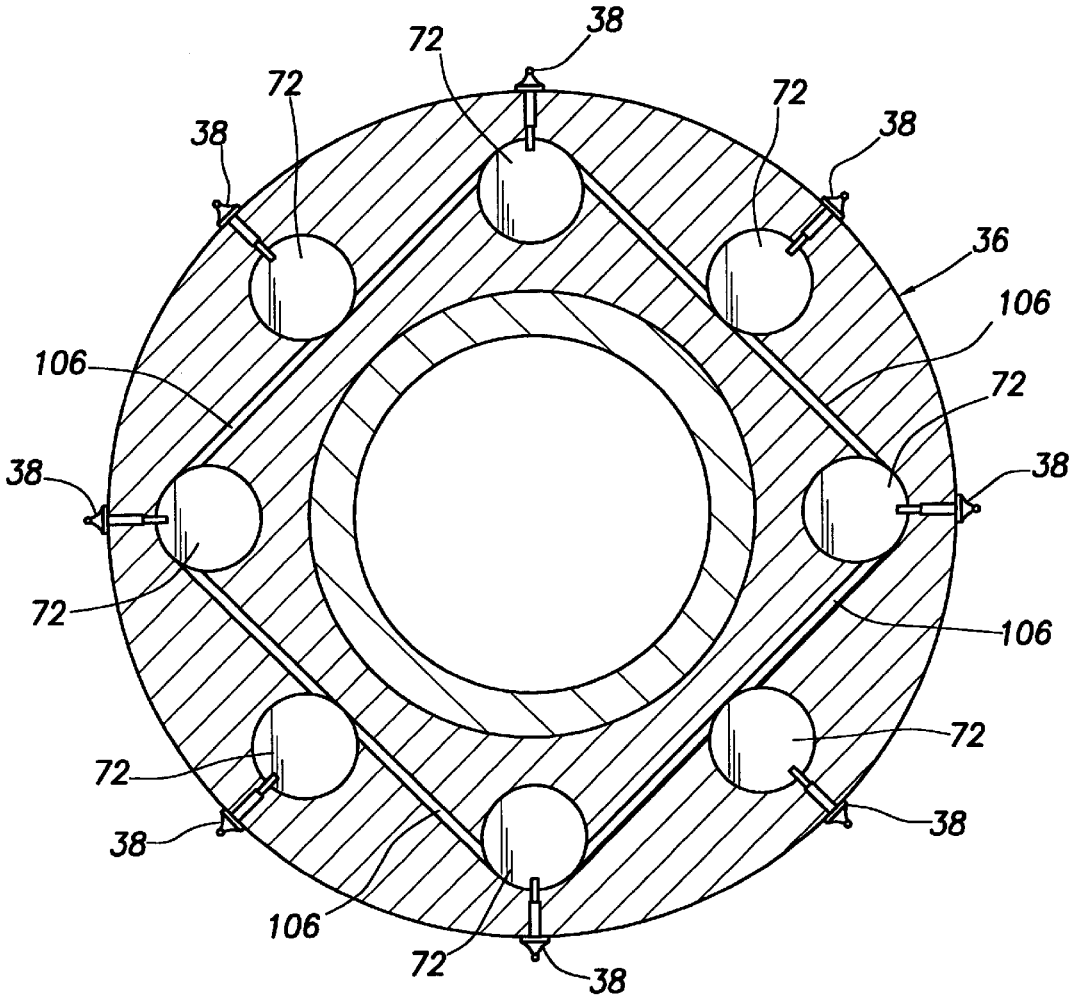
FIG. 5 is a cross-sectional view of a portion of the piston housing showing hydraulic communication taken along plane V—V in FIG. 4.

Referring now to FIGS. 4 and 5, an alternative embodiment for an exemplary retaining assembly 70 is illustrated with the liner 20 inserted and securely affixed therewithin. For simplicity, like reference numerals are used for like or similar components. FIG. 5 is a cross-sectional view of the hydraulic cylinder 36 taken along plane V—V in FIG. 4.

In this embodiment, hydraulic cylinder 36 defines a plurality of individual piston chambers 72. There are 4, 6, or 8 chambers 72 (depending on the holding force required) which are azimuthally spaced around hydraulic cylinder 36. Each piston chamber 72 contains a wear cylinder sleeve 101 with an individual piston 74 that is reciprocably disposed therein. Wear sleeve 101 includes threaded bores 103 for receiving bolts to assist in the replacement of sleeves 101 when excessive wear has occurred. Each piston 74 provides an elongated shaft 76 and a radially extending flange 78 so that when disposed within the chamber 72, the chamber 72 is divided into a spring retaining chamber 80 and fluid chamber 82. The shaft 76 of the piston 74 is threaded at 84 for threadingly receiving a nut 86. Fluid may be introduced into the fluid chamber 82 through an associated hydraulic fluid port and external fitting 38.

A cover 88 is placed over the open end 15 of liner 20, the cover 88 having a central opening 90 through which liner 20 is disposed. The cover 88 also includes apertures 92 for the disposal of each piston shaft 76. The cover 88 serves to provide a solid surface against which Belleville springs 94 may be compressed. O-ring seals 96 surround the flange 78 of each piston 74 to ensure fluid sealing.

An end cap 98 is shown disposed over the cover 88. The end cap 98, like the cover 88, provides apertures 100 for receiving piston shafts 76. However, the central aperture 102 is only large enough to permit a portion of the liner 20 to be disposed therethrough, creating a shoulder 104 which mates with the shoulder 60 of liner 20.

Referring particularly to FIG. 5, a plurality of fluid passages 106 are provided in hydraulic cylinder 36 which interconnect and communicate with each piston chamber 72 and each of the ports and fittings 38 on the hydraulic cylinder 36. The fluid interconnection permits all of the fluid chambers 82 (FIG. 4) to be filled with fluid by using only one or a few of the hydraulic fluid ports and fittings 38 for injecting fluid. The common communication with all fluid chambers 82 also allows the common hydraulic actuation of all the pistons 74 (FIG. 4).

In operation as shown in FIG. 4, the liner 20 is installed and removed in a manner similar to that described with respect to liner retaining assembly 18. Fluid is introduced into each individual fluid chamber 82 urging the associated piston 74 to move toward the open end 15 of liner 20. Energy is stored through axial compression of the Belleville springs 94. The end cap 98 is placed onto the liner open end 15 so that the shoulder 104 engages shoulder 60 of liner 20. Nuts 86 are then tightened onto each piston 74. Again, the nuts need only be hand tightened. Fluid is then evacuated from the fluid chambers 82 and the Belleville springs 94 bias pistons 74 toward the wear plate 14 and the module 10, thus loading liner 20 longitudinally against wear plate 14 and module 10.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. An assembly for releasing and securing a liner to a pump housing, comprising:

a first member adapted to be connected to the housing;

a second member disposed on said first member and adapted for extending around and engaging the liner;

a first biasing member extending around the liner and engaging said first and second members to bias said second member and the liner in a first direction towards the housing to secure the liner to the housing, said first biasing member applying a uniform annular force around the liner; and a second biasing member engaging said first and second members to bias said second member in a second direction away from the housing to relieve the bias of said first biasing member to unsecure the liner from the housing.

2. The assembly of claim 1 wherein said first biasing member is a spring extending around the liner.

3. The assembly of claim 1 wherein said second biasing member is hydraulic fluids and said second member comprises a removable end cap manually removable from said second member when the bias of said biasing member is relieved.

4. The assembly of claim 1 wherein said first member includes an annular housing cylinder and said second member includes an annular piston disposed within said housing cylinders said annular piston having a first position distal from the pump housing when engaging said second biasing member.

5. The assembly of claim 4 wherein said annular piston forms an annular fluid chamber and an annular spring chamber in said cylinder, said fluid chamber being supplied with fluid and said spring chamber having springs disposed therein.

6. An assembly for releasing and securing a liner to a pump housing, comprising:

a first member adapted to be connected to the housing and having an annular projecting portion forming a plurality of interconnected hydraulic chambers azmuthally spaced around said annular projecting portion;

a second member disposed in each of said plurality of chambers of said first member and extending through apertures in a retainer member engaging the liner;

a plurality of first biasing members, one of said first biasing members extending around each of said second members and engaging said first and second members to bias said second members and the liner in a first direction towards the housing to secure the liner to the housing; and said plurality of interconnected hydraulic chambers in said annular projecting portion hydraulically engaging said first and second members to bias said second members in a second direction away from the housing to relieve the bias of said first biasing members on said retainer member to unsecure said retainer member and the liner from the housing.

7. A liner retaining assembly comprising:

a) a cylinder within which a liner is disposed, the cylinder having a first end and a second end;

b) an annular piston disposed within the cylinder proximate the second end and being axially moveable within the cylinder, the piston further adapted to extend around a liner;

c) means to secure the annular piston to a portion of the liner; and d) biasing means to urge the piston and a liner toward the first end of the cylinder, the biasing means applying a predetermined uniform prestress around the liner.

8. The liner retaining assembly of claim 7 further comprising a single fluid reservoir which can be filled with fluid to urge the piston toward the second end of the cylinder.

9. The liner retaining assembly of claim 7 wherein the biasing means comprises at least one axially compressible spring which extends around the liner.

10. The liner retaining assembly of claim 7 wherein the means to secure the annular piston to a portion of a liner comprises a threaded end cap, the end cap having a first compressed state when said biasing means is applied and a relaxed state when said biasing means is not applied.

11. A method for securing a piston cylinder liner on a pump housing, the method comprising:

a) disposing the liner within a cylinder to abut the pump housing;

b) compressing a spring extending around the liner to store energy for uniformly biasing the liner against the pump housing;

d) releasing the stored energy; and e) applying a uniform annular force around the liner to longitudinally compress the liner and urge it against the pump housing.

12. The method of claim 11 wherein the cylinder includes a common portion and further comprises flowing hydraulic fluid into common portion of the cylinder to compress the spring.

13. The method of claim 12 further comprising affixing an end cap to transmit the stored energy to the liner and being manually removed when the bias of the spring member is relieved.

* * * * *